US009168526B2

(12) United States Patent
Shi et al.

(10) Patent No.: US 9,168,526 B2
(45) Date of Patent: Oct. 27, 2015

(54) HINGED CAP FOR DIAGNOSTIC DEVICE

(75) Inventors: Qinwei Shi, Richmond Hill (CA); Florian Eckhardt, Berlin (DE)

(73) Assignee: ZBx Corporation, Toronto (CA)

( * ) Notice: Subject to any disclaimer, the term of this patent is extended or adjusted under 35 U.S.C. 154(b) by 735 days.

(21) Appl. No.: 12/818,297

(22) Filed: Jun. 18, 2010

(65) Prior Publication Data

US 2010/0323433 A1 Dec. 23, 2010

Related U.S. Application Data

(60) Provisional application No. 61/218,406, filed on Jun. 19, 2009.

(51) Int. Cl.
*B01L 3/14* (2006.01)
*B01L 3/00* (2006.01)

(52) U.S. Cl.
CPC ..... *B01L 3/502715* (2013.01); *B01L 2200/027* (2013.01); *B01L 2300/043* (2013.01); *B01L 2300/0825* (2013.01)

(58) Field of Classification Search
CPC ..... B01L 3/50825; B01L 2300/04; B01L 2300/041; B01L 2300/043; B01L 3/523
USPC ..... 422/405, 420, 550
See application file for complete search history.

(56) References Cited

U.S. PATENT DOCUMENTS

| | | | | |
|---|---|---|---|---|
| 2,544,382 | A * | 3/1951 | Grunwald et al. | 222/484 |
| 3,036,747 | A * | 5/1962 | Girard | 222/507 |
| 3,369,720 | A * | 2/1968 | Libit et al. | 222/517 |
| 5,810,775 | A | 9/1998 | Shaw | |
| 7,778,865 | B1 | 8/2010 | Kane | |
| 7,785,865 | B2 | 8/2010 | Qinwei | |
| 2004/0007585 | A1 | 1/2004 | Griffith et al. | |
| 2005/0196318 | A1 | 9/2005 | Matusewicz et al. | |
| 2006/0110285 | A1 | 5/2006 | Piasio et al. | |
| 2007/0212258 | A1 | 9/2007 | Neel et al. | |
| 2008/0112848 | A1 | 5/2008 | Huffstodt et al. | |
| 2008/0166791 | A1 | 7/2008 | Kim et al. | |
| 2009/0098018 | A1* | 4/2009 | Bainczyk et al. | 422/68.1 |
| 2010/0126993 | A1* | 5/2010 | Broadhead et al. | 220/230 |
| 2010/0240142 | A1* | 9/2010 | Saiki et al. | 436/164 |

FOREIGN PATENT DOCUMENTS

| | | |
|---|---|---|
| EP | 0164148 | 12/1985 |
| WO | WO 95/08117 | 3/1995 |
| WO | WO 01/29558 | 4/2001 |
| WO | WO 02/059600 | 8/2002 |
| WO | WO 2006/042004 | 4/2006 |
| WO | WO2007/000048 | 1/2007 |
| WO | WO2008/092639 | 8/2008 |
| WO | WO 2009060617 A1 * | 5/2009 |

* cited by examiner

*Primary Examiner* — Jill Warden
*Assistant Examiner* — Dwayne K Handy
(74) *Attorney, Agent, or Firm* — Sim & McBurney

(57) ABSTRACT

A hinged cap for engaging a housing of a diagnostic device comprises a central body; two arms extending from opposing sides of one end of said central body, said arms being substantially parallel; each of said arms comprising a cap hinge member for engaging a housing hinge member on said housing, wherein said cap hinge member and said housing hinge member define a hinge axis around which said cap is pivotable between an open and a closed position with respect to said housing.

34 Claims, 6 Drawing Sheets

HINGED CAP FOR DIAGNOSTIC DEVICE

FIELD OF THE INVENTION

This invention relates to diagnostic devices. More specifically, this invention is directed to a novel hinged cap for a diagnostic device and to devices incorporating such.

BACKGROUND OF THE INVENTION

Throughout this application, various references are cited to describe more fully the state of the art to which this invention pertains. The disclosures of these references are hereby incorporated by reference into the present disclosure in their entirety.

Diagnostic devices currently exist for detecting the presence of an analyte in a sample of biological fluid. Typically, such diagnostic devices have an exposed end or aperture for application of the biological fluid to be tested and a closed end for detecting the analyte and displaying the result of the diagnostic test. Examples of such diagnostic devices include pregnancy tests and glucose meters.

WO 95/08117, WO 01/29558, WO 02/059600, WO 06/042004, U.S. 2005/0196318, US 2006/0110285, and EP 0164148 are directed to conventional two-part diagnostic devices where a biological sample is applied to one part of the diagnostic device and reagents are contained in the other part of the diagnostic device. The two parts of these diagnostic devices are then connected together and folded on top of one another thereby mating the two parts and completing the diagnostic test.

U.S. 2008/0112848 is directed to a dry test strip assembly that has a base and a cover. The cover is attached to the base at the distal end of the base and compresses a test strip onto the base. The base has a plurality of test ports for conducting more than one diagnostic test simultaneously and the cover includes a sample opening that is aligned over the test ports when in the closed position. The compression provided by the cover serves to divide the test strip into discrete testing portions and sample is applied through the window in the cover.

Applicant's copending application, U.S. Ser. No. 11/475,948, filed Jun. 28, 2006, describes an analytical device that comprises a membrane array supported within a housing. One end of the housing is adapted to receive a removable cap. The cap is an optional separate piece that can be laterally snapped onto and off of the housing.

While the aforementioned diagnostic devices and caps are generally useful, it is desirable to provide a cap for a diagnostic device that overcomes the deficiencies of the prior art and further provides other advantages to the device itself.

SUMMARY OF THE INVENTION

The present invention is an improved cap for a diagnostic device and a diagnostic device incorporating such a cap. The cap is hingedly connected to the diagnostic device and can be pivoted back and forth from an open position to a closed position as desired. In the open position, a biological sample, such as from a lancet procedure or a finger-stick, may be applied directly to a sample flow channel in the diagnostic device. In an aspect, the cap when open acts as a support for the diagnostic device, propping it up for hands-free use. In the closed position, the biological sample may be applied to the diagnostic device with a sample transfer device, such as a micropipette.

When the cap is in the closed position, the user is protected from the biological sample and, similarly, the biological sample is protected from any contamination by the user or the surrounding environment. Since the cap is attached to the diagnostic device, the risk of the cap being misplaced or of confusing caps and diagnostic test results with one another is minimized. In an aspect, the cap is designed to be large enough such that identifying information can be written thereon or affixed thereto.

According to an aspect of the present invention there is provided a hinged cap for engaging a housing of a diagnostic device, the cap comprising: a central body; two flexible arms extending from opposing sides of one end of said central body, said arms being substantially parallel; each of said arms comprising an inwardly facing hinge member for engaging an outwardly facing hinge member on said housing, wherein said inwardly facing hinge member and said outwardly facing hinge member define a hinge axis around which said cap is pivotable between an open and a closed position with respect to said housing.

In an aspect, at least one of said arms comprises an inwardly facing lock for releasably engaging an outwardly facing point on said housing, thereby locking said cap in the closed position.

In another aspect, the cap further comprises a stop extending from said end of said central body between said arms for contacting a point on said housing and preventing said cap from pivoting beyond said closed position.

In another aspect, said central body comprises a sloping surface and side walls that cooperate to form a sample transfer device guide channel, said channel terminating at a point on said end of said central body between said arms.

In another aspect, said guide channel aligns with an indent in, the housing when the cap is in the closed position.

In another aspect, said lock is a protuberance that engages a groove on the housing. In another aspect, said lock is a groove that engages a protuberance on the housing.

In another aspect, the inwardly facing hinge member is a post and the outwardly facing hinge member is an aperture. In another aspect, the inwardly facing hinge member is an aperture and the outwardly facing hinge member is a post.

In another aspect, said housing has a proximal end for engaging said cap, a distal end, and a midpoint thereinbetween, said hinge axis being located between said midpoint and said proximal end. In another aspect, said housing has a viewing window between said proximal end and said distal end, said hinge axis being located between said viewing window and said proximal end.

In another aspect, said central body comprises a gripping surface. In another aspect, said central body comprises a writing surface.

In another aspect, said sample is selected from the group consisting of whole blood, serum, plasma, urine, saliva, sweat, spinal fluid, lacrimal fluid, vaginal fluid, semen, tissue lysate and combinations thereof. In another aspect, said sample is whole blood.

According to another aspect of the present invention, there is provided a diagnostic device comprising the cap described herein.

In another aspect, said housing comprises a sample flow channel with an opening at the proximal end of said housing, wherein said opening is protected by said cap when said cap is in the closed position and said opening is exposed when said cap is in the open position.

In another aspect, said housing is provided with an upper half and a lower half that attach to one another to enclose a membrane that is in fluid communication with said sample flow channel.

In another aspect, said membrane is a lateral flow membrane. In another aspect, said membrane is an enzymatic detection membrane. In another aspect said membrane is an immunodetection membrane.

Other features and advantages of the present invention will become apparent from the following detailed description. It should be understood, however, that the detailed description and the specific examples while indicating embodiments of the invention are given by way of illustration only, since various changes and modifications within the spirit and scope of the invention will become apparent to those skilled in the art from the detailed description.

BRIEF DESCRIPTION OF THE DRAWINGS

Embodiments will now be described, by way of example only, with reference to the attached figures, wherein.

DETAILED DESCRIPTION OF THE INVENTION

The present invention is a novel hinged cap for a diagnostic device and diagnostic devices incorporating such, the caps and diagnostic devices providing ease of assembly and use, safety, uncompromised samples, and the choice of either applying a biological fluid directly from the user's body or indirectly by using a transfer device such as a micropipette. The diagnostic device and cap can be used with any type of membrane array known in the art and, in aspects, may be used with a membrane array disclosed in, for example, Applicant's U.S. patent application Ser. No. 10/681,639, U.S. Ser. No. 10/711,408, U.S. Ser. No. 11/475,948, or U.S. Ser. No. 11/993,013, each of which is incorporated herein by reference in its entirety. The diagnostic device and cap may also be used without a membrane by simply coating reagents on the inside surfaces of the diagnostic device, for example. When the cap is opened, it may serve as a stand or leg that holds or supports the device in an upright position to assist a user to self-test using a capillary blood sample from a finger-stick/lancet procedure. When the cap is closed, it may serve as a guide to direct a sample into an opening in the diagnostic device.

Figure 1:
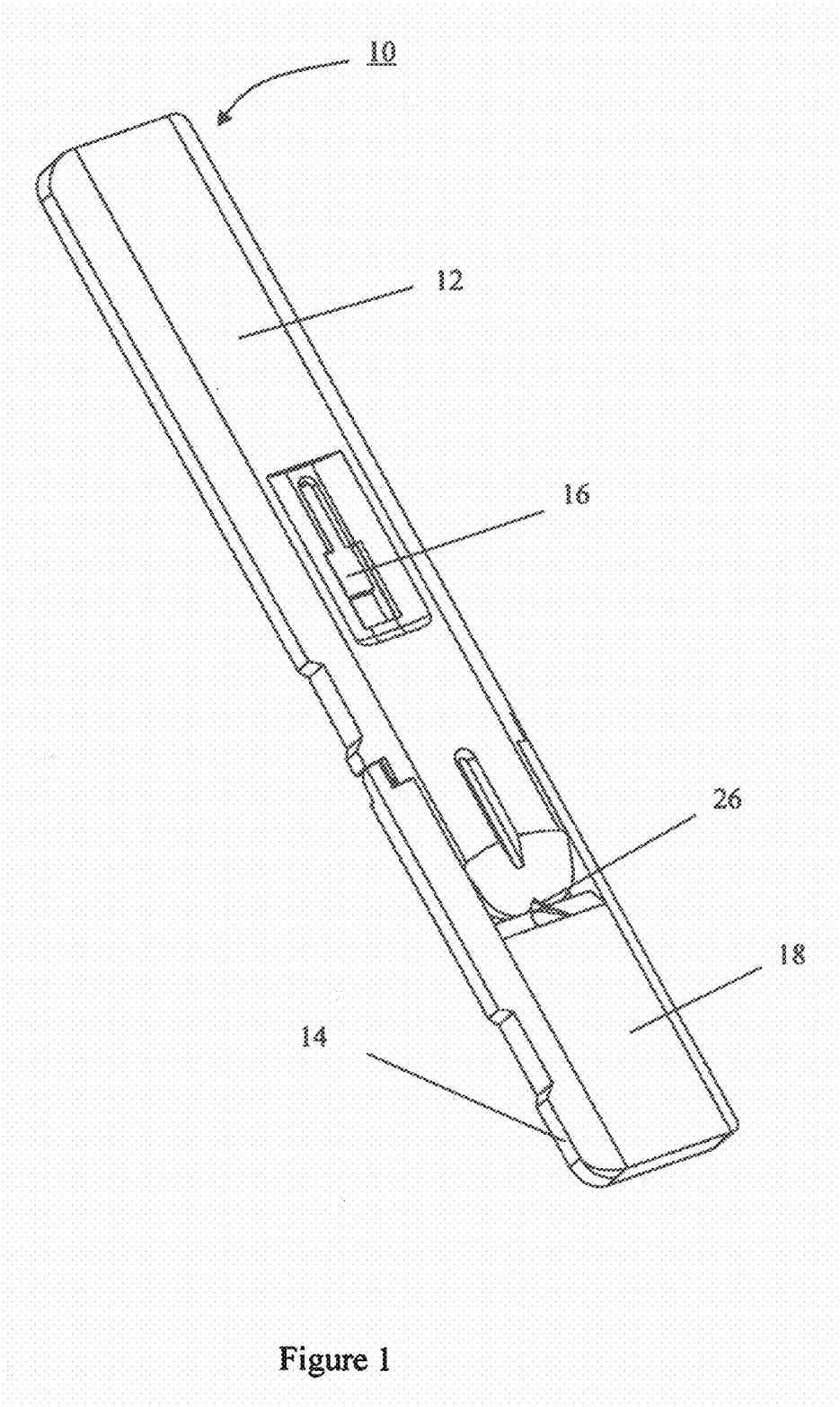
FIG. 1 is a front perspective view of a diagnostic device of the invention, with the cap in the closed position.

The invention is now herein described with reference to FIG. 1 which shows the diagnostic device 10 including a housing 12 and the novel hinged cap 14 of the invention. The housing 12 has a viewing window 16, where the result of a diagnostic test can be read by a user. The viewing window 16 is located approximately mid-way between the two longitudinal ends of the housing 12. The end of the diagnostic device 10 to which the biological sample is applied is referred to as the "proximal" or "upstream" end. The opposite end of the diagnostic device 10 is referred to as the "distal" or "downstream end".

Figure 2A:
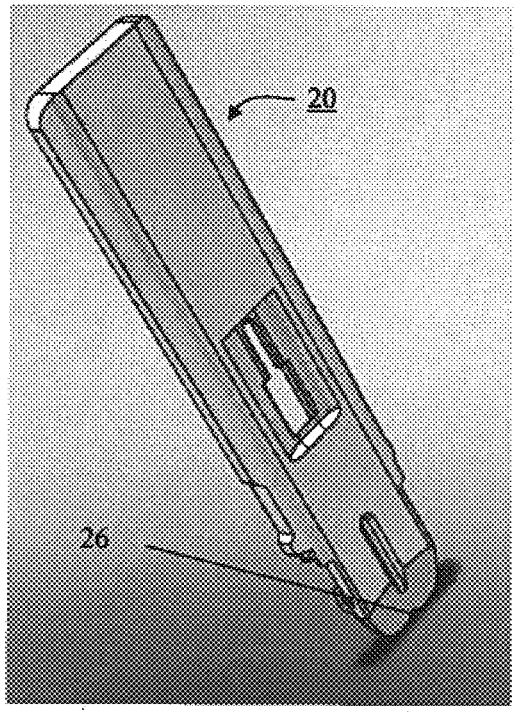
FIG. 2A is front perspective view of the upper half of the housing of the diagnostic device shown in FIG. 1.
Figure 2B:
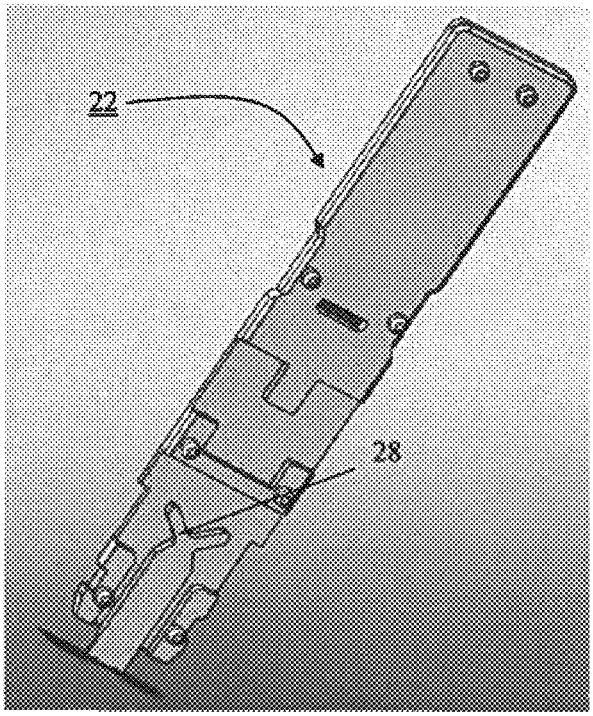
FIG. 2B is a front perspective view of the lower half of the housing of the diagnostic device shown in FIG. 1.

The housing 12 includes an indent 26 at the proximal or upstream end, where the biological sample is applied to the diagnostic device 10. As is shown in FIGS. 2A and 2B, the housing 12 of the diagnostic device 10 has an upper half 20 and a lower half 22 that cooperate to enclose a membrane, upon which the diagnostic test takes place. The upper half 20 and the lower half 22 of the housing 12 together form a sample flow channel, which is an open-ended chamber where the biological sample enters the housing 12 of the diagnostic device 10. The indent 26 is located at the proximal end of the upper half 20 of the housing 12 and is at the opening to the sample flow channel. The indent 26 facilitates entry of the biological sample into the sample flow channel and is used to guide a sample transfer device, as will be described. The diagnostic device is useful with small sample volumes of, for example, 50 μl or less.

The upper half 20 and the lower half 22 of the housing 12 are specifically shaped so as to enclose the membrane used for conducting the diagnostic test. For example, if the membrane is shaped with an apex at the proximal end, the lower half 22 of the housing 12 may be designed to have a Y-shaped protrusion 28 so to position and stabilize the membrane, as is shown in FIG. 2B. The upper half 20 and the lower half 22 of the housing 12 are also provided with corresponding projections and apertures for connecting the upper half 20 and the lower half 22 together.

Figure 2C:
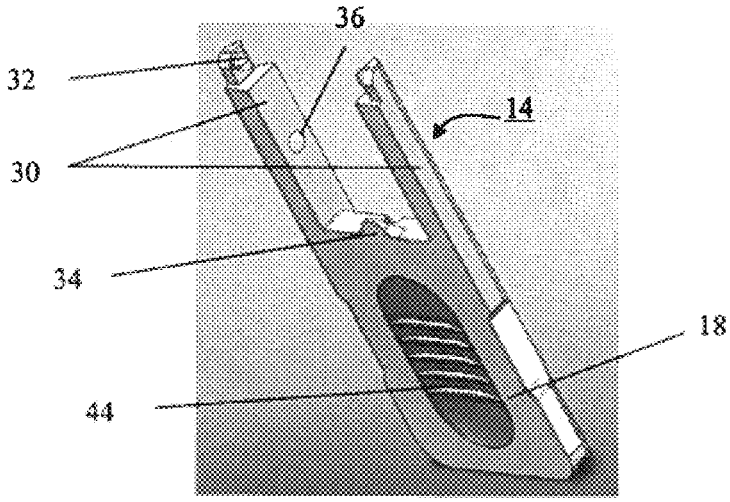
FIG. 2C is a back perspective view of the cap of the diagnostic device shown in FIG. 1.

The cap 14 of the invention is shown in isolation in FIG. 2C. The cap 14 includes a central body 18 and two flexible arms 30. The arms 30 extend substantially parallel from the central body 18 and each arm 30 is provided with an inwardly facing joint or hinge member 32 at the end, engageable with an outwardly facing hinge member on the housing 12 of the diagnostic device 10. The inwardly facing hinge member 32 and the outwardly facing hinge member together form a hinge that defines an axis around which the cap 14 may pivot. A "hinge" is understood to be a jointed device or flexible piece on which an attached part pivots, turns, swings, or moves. In an aspect, the hinge member 32 is a post. The cap 14 is applied to the housing 12 by flexing the arms 30 and mating the hinge members 32 with the corresponding hinge members located on the housing 12 to form a hinge axis about which the cap 14 is pivotable. The housing hinge members are generally located between the proximal end of the housing 12 and the viewing window 16. The arms 30 are approximately the same length as the distance from the proximal end of the diagnostic device 10 to the housing hinge members, so that the cap 14 is freely pivotable about the hinge axis and yet blocks the sample flow channel when in the closed position. The term "pivot" is understood to mean turning or causing to turn in place, as on a hinge or fixed point, tracing an arclike path. Once the cap 14 is engaged with the housing 12, the cap 14 is firmly attached thereto and can only be removed as a separate piece from the housing 12 with the application of force.

The arms 30 of the cap 14 include a lock member that mates with a mating lock member found on the housing 12. In an aspect, the lock members are protuberances 36 on the arms 30 of the cap 14 that register with grooves 38 on the housing 12.

When the protuberances 36 and the grooves 38 align, they lock together, maintaining the cap 14 in a closed position and protecting the sample flow channel and any biological sample therein from contamination.

Figure 3:
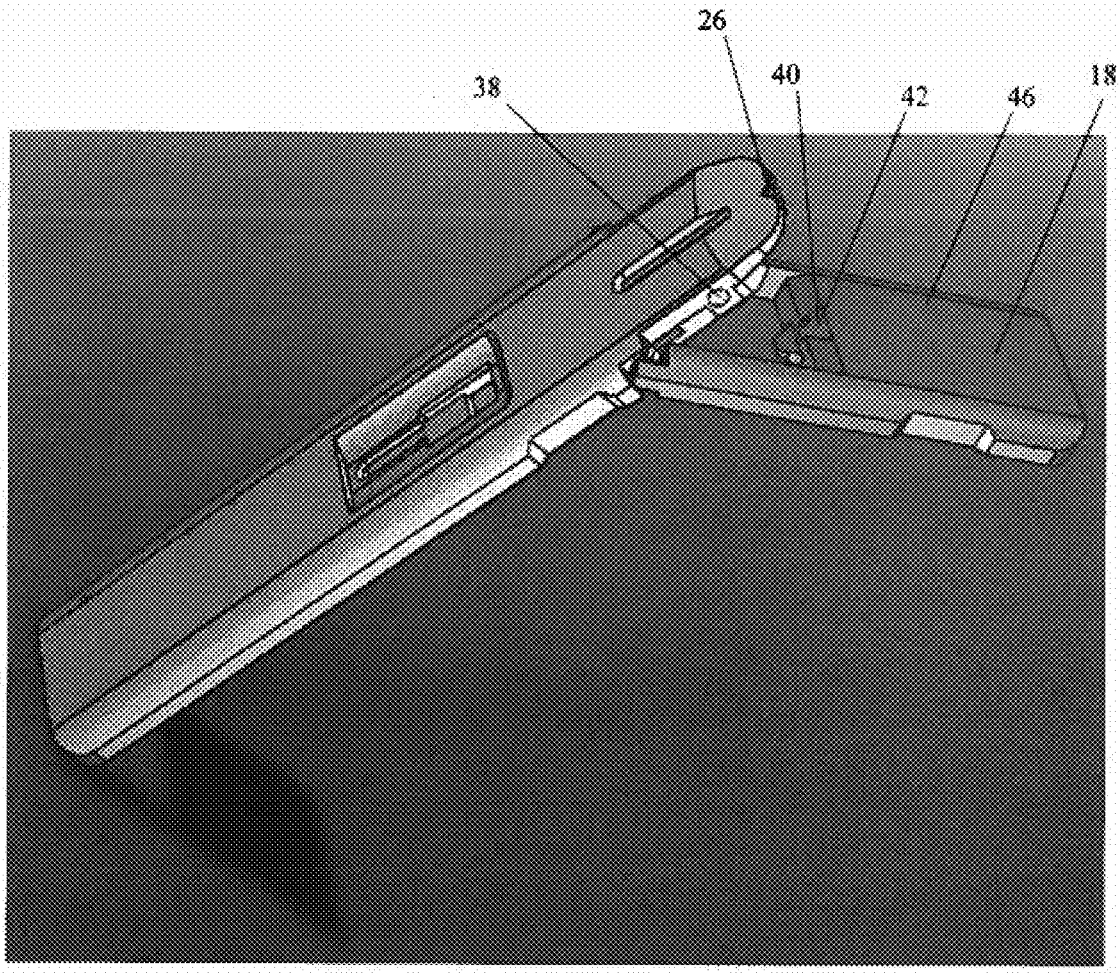
FIG. 3 is a front perspective view of the diagnostic device shown in FIG. 1 with the cap in the open position.

The cap 14 further includes a stop 34 that extends from the cap 14 towards the housing 12. The stop 34 permits the cap 14 to pivot from a closed position toward one open direction but not toward the other open direction. In the diagnostic device 10 shown in FIG. 3, the cap can pivot in the downward direction until it is approximately at a 90 degree angle with the housing 12. When pivoted toward the housing 12 and the closed position, the cap 14 stops when it is approximately at a 180 degree angle with respect to the housing 12. The stop 34 prevents the cap 14 from pivoting further upward and beyond the closed position. It will be understood that the stop 34 may alternatively be in the opposite configuration, such that the cap 14 is pivotable from the upward direction toward the closed position and no further.

It will be apparent that when the cap is in the open position, it exposes the sample flow channel, such that the biological sample can be directly applied to the sample flow channel from, for example, a finger lancet procedure or finger-stick or by dipping the open end of the sample flow channel into the biological sample. Once the sample is applied to the diagnostic device 10, the cap 14 can be closed, thereby protecting the biological sample from contamination and protecting the user from the biological sample. The opening and closing of the cap may be performed quickly and easily with only one hand.

The cap 14 is also designed to facilitate the application of a small volume of sample to the diagnostic device 10 by using a transfer device or micropipette. In this way, the cap 14 is multi-functional and can be used to protect the user after the biological sample is applied to the diagnostic device 10, either directly from a finger lancet procedure or by dipping into a biological sample, or to facilitate indirect sample application using a transfer device such as a micropipette. The cap 14 is provided and fitted to serve as a guide for the placement of the micropipette tip prior to ejection of the sample towards the indent 26 of the housing 12. More particularly, the cap 14 is provided with a sloping surface 40 having side walls 42 that form a guide channel in the central body 18. The guide channel is designed to guide the micropipette tip to the indent 26, such that the sample when ejected enters the sample flow channel.

The cap 14 has a gripping surface 44 on one side and a writing surface 46 on the other side. The gripping surface 44 facilitates the initial application of the cap 14 to the housing 12 and aids in opening and closing the cap 14. The gripping surface 44 also provides a comfortable and secure means for holding the diagnostic device 10 when the cap 14 is in the closed position.

Figure 4:
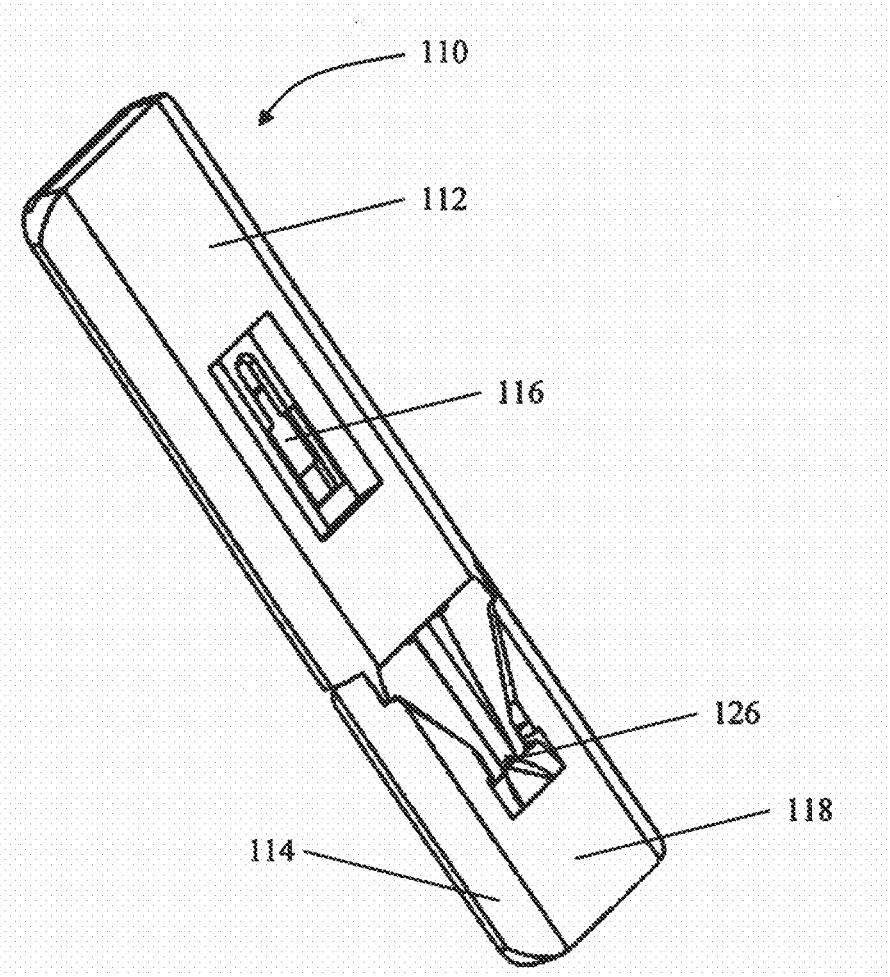
FIG. 4 is a front perspective view of another embodiment of the diagnostic device of the invention, with the cap in the closed position.
Figure 5A:
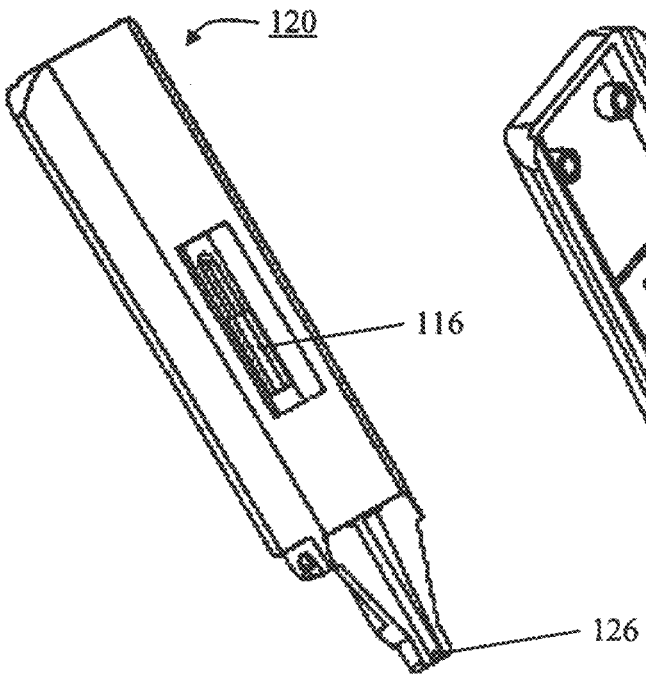
FIG. 5A is a front perspective view of the upper half of the housing of the diagnostic device shown in FIG. 4.
Figure 5B:
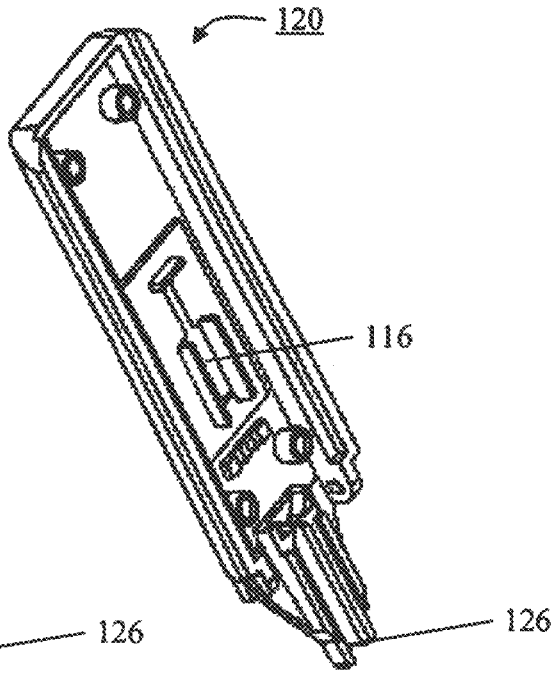
FIG. 5B is a back perspective view of the upper half of the housing of the diagnostic device shown in FIG. 4.
Figure 5C:
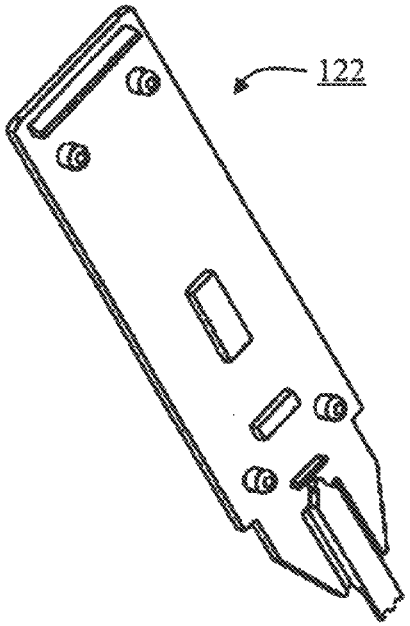
FIG. 5C is a front perspective view of the lower half of the housing of the diagnostic device shown in FIG. 4.
Figure 5D:
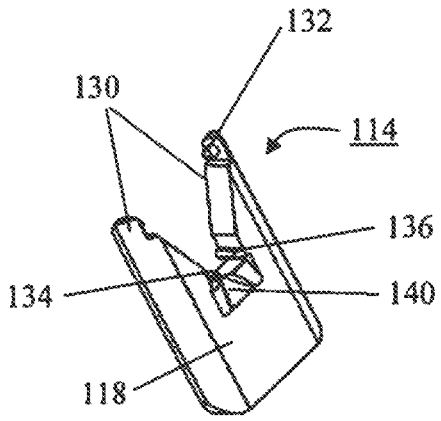
FIG. 5D is a front perspective view of the cap of the diagnostic device shown in FIG. 4.
Figure 6:
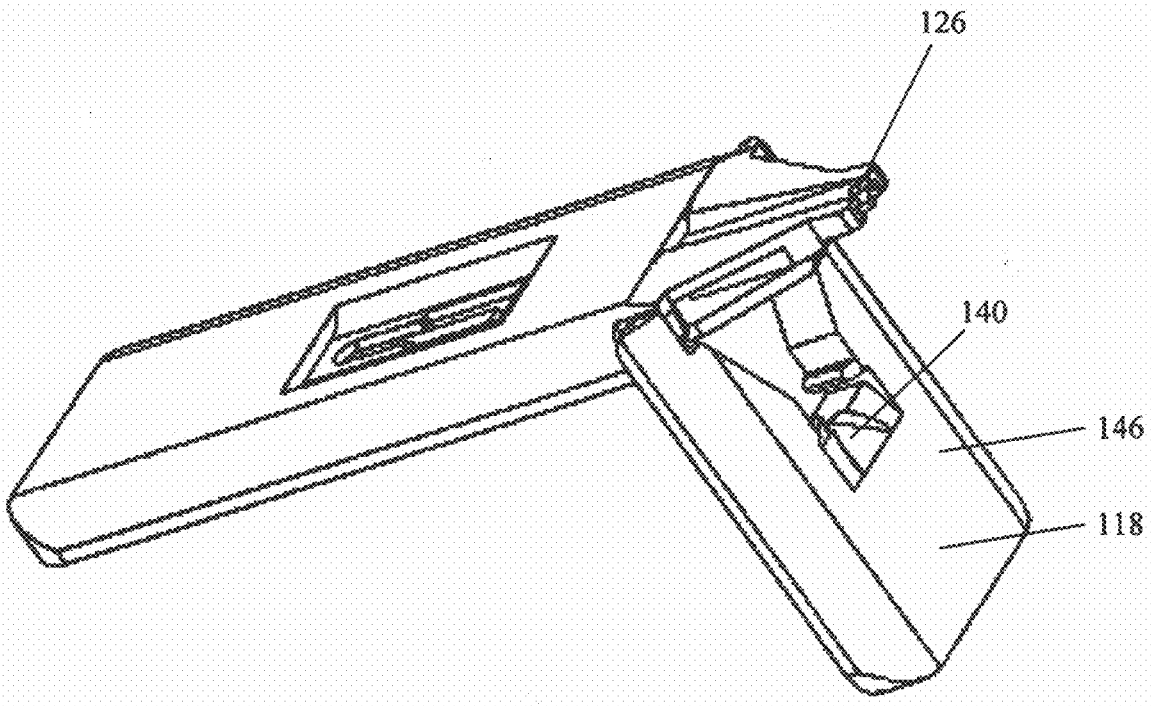
FIG. 6 is a front perspective view of the diagnostic device shown in FIG. 4 with the cap in the open position.

Referring now to FIGS. 4 to 6, another aspect of the diagnostic device 110 is shown. The diagnostic device 110 is smaller than the diagnostic device 10 and may be suitable for use with smaller biological sample volumes, such as volumes of about 20 μl or less. The diagnostic device 110 includes a housing 112 and the novel hinged cap 114 of the invention. The housing 112 has a viewing window 116 and an indent 126 at the proximal or upstream end. As is shown in FIGS. 5A, 5B, and 5C, the housing 112 of the diagnostic device 110 has an upper half 120 and a lower half 122 that cooperate to enclose a membrane. The upper half 120 and the lower half of the housing 112 together form a sample flow channel, as has been described above for the diagnostic device 10.

It will be evident that the upstream end of the housing 12 of the diagnostic device 10 is generally U-shaped and rounded, whereas the upstream end of the housing 112 of the diagnostic device 110 is tapered. This tapering is an optional feature that not only facilitates sample application directly to the sample flow channel but also reduces possible sample contamination.

The cap 114 for use with the diagnostic device 110 of the invention is shown in FIG. 5D. As has been described above with respect to the cap 14, the cap 114 includes a central body 118 with a sloping surface 140 and two flexible arms 130. The flexible arms 130 are shaped to match the tapered and of the diagnostic device 110 so as to provide a mating fit when the cap 114 is in the closed position. Thus, each arm 130 is itself tapered on at least one side. Each arm 130 is provided with an inwardly facing joint or hinge member 132 that is engageable with an outwardly facing hinge member on the housing 112 of the diagnostic device 110 so that the cap 114 may pivot about the housing 112. The cap 114 is applied to the housing 112 by flexing the arms 130 and mating the hinge members 132 with the corresponding hinge members located on the housing 112 to form a hinge axis about which the cap 114 is pivotable. Once the cap 114 is engaged with the housing 112, the cap 114 is firmly attached thereto and can only be removed as a separate piece from the housing 112 with the application of force.

The arms of the cap 114 further include a lock member, such as a protuberance 136, that register with grooves on the housing 112. The cap 114 further includes a stop 134 that extends from the cap 114 towards the housing 112. The stop 134 prevents pivoting of the cap 114 in one direction with respect to the housing 112. The cap 114 may further be provided with a writing surface 146.

In use, the diagnostic device 10, 110 is either provided together with the cap 14, 114 already attached to the housing 12, 112 or is provided in two parts, wherein the user applies the cap 14, 114 to the housing 12, 112 before or after use of the diagnostic device 10, 110. In an aspect, the diagnostic device 10, 110 is provided together with the cap 14, 114 attached to the housing 12, 112 prior to the use of the diagnostic device 10, 110.

If the diagnostic device 10, 110 is to be used with the cap 14, 114 in the open position, the cap 14, 114 is opened and may be used to support the diagnostic device 10, 110 on a table or other surface, freeing both hands of the user. The biological sample is then applied directly to the sample flow channel. The indent 26, 126 in the housing 12, 112 helps in the capillary flow of the biological sample when the sample flow channel is blocked for example by a finger tip. Once the biological sample is applied, it enters the sample flow channel. The biological sample then encounters the membrane and continues to flow laterally into and through the membrane by capillary flow. The user closes the cap 14, 114 and awaits the result of the diagnostic test, viewable through viewing window 16, 116. In the meantime, information can be recorded on the writing surface of the cap or a pre-made sticker can be applied to the diagnostic device 10, 110, thereby identifying the biological sample and test result. There is little risk of confusing the diagnostic test results when many diagnostic tests are performed in a short period of time, since the caps 14, 114 are locked into place and cannot be removed as a separate piece from the housing 12, 112 of the diagnostic device 10, 110 without the application of force.

If the diagnostic device 10, 110 is to be used with the cap 14, 114 closed, the biological sample is first taken up into a transfer device, such as a micropipette. The tip of the transfer device is then inserted into the guide channel and the biological sample is ejected. The biological sample enters the sample flow channel by capillary flow and the user awaits the diagnostic test result, viewable through viewing window 16, 116.

It is also contemplated that the diagnostic test result may be read using a reader so as to provide a quantitative measurement and/or a qualitative measurement so as to reduce the chance of human error in reading a test result. In this aspect, the diagnostic device 10, 110 may be itself inserted into the reader. Providing the cap 14, 114 hingedly attached to the housing 12, 112, as has been described above, reduces the possibility of having two states of the diagnostic device 10, 110 (with or without the cap 14, 114), thereby facilitating the positioning of the diagnostic device 10, 110 in the reader.

The above-described cap and diagnostic device incorporating same is preferably used with a whole blood sample. However, it will be understood that the cap and diagnostic device can be used with any type of biological sample, including but not limited to whole blood, serum, plasma, urine, saliva, sweat, spinal fluid, lacrimal fluid, vaginal fluid, semen, tissue lysate and combinations thereof. The biological sample can be applied to the diagnostic device by dipping the end of the housing of the diagnostic device into the biological sample, by inserting the housing of the diagnostic device into the mouth, or by applying a drop of blood directly from the finger tip, for example, such that the biological sample flows into the sample flow channel until adequate sample has been collected to run the test. As described above, the biological sample can also be applied by using a transfer device such as a micropipette.

It will be understood that the sample volume required for the diagnostic device is non-limiting and may be varied depending upon the dimensions of the diagnostic device and/or membrane enclosed therein. In an aspect, the sample has a small sample volume, however, the diagnostic device is equally applicable to larger sample volumes. In an aspect, the volume used in the diagnostic device is 50 μl or less. In another aspect, the volume used in the diagnostic device is 20 μl or less. In aspects, as little as 5 μl of sample may be used with a sufficiently sensitive membrane or other test conditions.

The cap and housing have been described above as being two separate parts of a diagnostic device that can be attached together or removed from one another upon the application of force. It will be understood that the cap and housing need not be removable from one another and may instead be integrally formed such that the cap can pivot from a closed position, wherein the opening of the sample flow channel is protected, to an open position, wherein the opening is exposed.

The diagnostic device has been described above as having a viewing window, however in aspects the diagnostic device may be fabricated from a transparent material. In such an aspect, the diagnostic device need not have a separate viewing window. The position of the viewing window will be determined based upon the membrane enclosed within the housing of the diagnostic device and the dimensions of the diagnostic device itself. The position of the viewing window and the size of the device are understood to be non-limiting features.

The diagnostic device may be formed from any material or combination of materials that are body fluid compatible. In an aspect the material is a resilient plastic. In another aspect, the material is sterilizable. It will be understood that the material(s) from which the diagnostic device top and bottom and cap are made is non-limiting. The diagnostic device and cap may be made from the same or different materials.

The cap has been described above as having hinge members in the form of posts that interact with apertures on the housing of the diagnostic device to form a hinge axis. Other hinge means are known in the art and it will be understood that the cap can be connected to the housing in any manner that permits pivoting of the cap about the hinge axis. For example, the housing of the device could comprise posts and the cap could comprise apertures, or the cap could be connected to the housing by a pin that extends transversely through the housing in a manner that does not interfere with the sample flow channel or membrane therein.

It will be understood that the cap can connect to the housing at any point between the proximal and distal ends of the diagnostic device. The arms can be fabricated to be any suitable length such that the cap will pivot about the diagnostic device from an open position to a closed position. In an aspect, the arms are less than half of the length of the diagnostic device and in another aspect the arms are less than one quarter of the length of the diagnostic device. However, arms of any length are contemplated herein. Similarly, the hinge axis may be located at any point between the two ends of the housing. For example, the hinge axis could be located between the midpoint of the housing and the proximal end (the end to which the cap attaches to the housing). In an aspect the housing includes a viewing window and the hinge axis is located between the viewing window and the proximal end of the device. It will be understood that the location of the hinge axis on the housing and the length of the arms are interrelated. The arms are long enough that, when the cap is attached to the housing, it is freely pivotable between at least one open position and the closed position. Similarly, the arms are short enough that the cap blocks the sample flow channel when it is in the closed position.

In aspects described above, the cap includes a stop for preventing free pivoting of the cap in one direction. The stop could alternatively be located on the housing. The cap also includes a protuberance that engages a groove in the housing, thereby reversibly locking the cap in the closed position. These features could be switched such that the housing comprises a protuberance and the cap comprises a groove. It will be understood that these are optional features and the diagnostic device is capable of use without these features. Similarly, the gripping surface and writing surface are merely preferred aspects and these are not required for successful operation of the cap described above and the diagnostic device incorporating the cap.

Any type of membrane can be used with the diagnostic device and cap described herein. Examples include immunodetection membranes and enzymatic membranes. In one aspect, the membrane is a membrane array comprising at least three membrane layers arranged in a stair-step configuration where the pore size decreases in each successive step. This membrane array is particularly suited for the rapid analysis of analytes and components of fluid samples and in particular the analysis of small volumes of fluid samples. In aspects, the membrane array is particularly suited for the rapid analysis of components of whole blood using a one step procedure. The diagnostic test is conducted with minimal invasiveness as only a small amount of blood is required to obtain high sensitivity detection without background interference and with minimal hemolysis.

In another aspect, the membrane is a chromatographic membrane for detecting the presence, absence or quantity of an analyte of interest in a biological sample. In a first step, the biological sample is added to the membrane, and moves by capillary action across a test zone containing an immobilized ligand which is a capture molecule. A labeled detection reagent which detects the presence of the analyte is provided with the membrane, stored in a resolubilizable form. In a second step, the dry labeled reagent and an absorbent sink are brought into contact with the wetted membrane, thereby resolubilizing the reagent, and drawing it through the test zone by the forces of capillary action.

In another aspect, the membrane is an enzymatic analytical membrane for rapidly determining the presence or absence of small molecule analytes such as ethanol, acetylsalicylic acid, methanol, acetaminophen, homocysteine, cholesterol, urea, and combinations thereof in one step with high efficiency and sensitivity in a small volume of a biological sample such as blood. The enzymatic analytical membrane for detecting the presence of one or more small-molecule analytes in a biological sample, the membrane comprises, in order, a receiving zone, a separation zone and a signal zone. At least one of these zones comprises one or more enzymes for converting said analytes into a form detectable by reaction with a chromogenic agent present in the signal zone. The membrane laterally receives the sample at an edge of the receiving zone, and the sample continues via lateral flow through the receiving zone, separation zone and signal zone where a visible color change is formed indicating the presence of the analyte.

Any other type of membrane known to a skilled person is contemplated herein. The diagnostic device described herein could also be used without a membrane and could simply have the desired reagents imprinted or coated on the inside of the diagnostic device.

The description as set forth is not intended to be exhaustive or to limit the scope of the invention. Many modifications and variations are possible in light of the above teaching without departing from the spirit and scope of the following claims. It is contemplated that the use of the present invention can involve components having different characteristics. It is intended that the scope of the present invention be defined by the claims appended hereto, giving full cognizance to equivalents in all respects.

The invention claimed is:

1. A diagnostic device for assaying a biological sample, the diagnostic device comprising:

a housing; and a hinged cap for engaging the housing, the hinged cap comprising:

a central body;

two arms extending from opposing sides of one end of said central body, said arms being substantially parallel;

each of said arms comprising a cap hinge member for engaging a corresponding housing hinge member on said housing, wherein said cap and housing hinge members define a hinge axis around which said cap is pivotable in order between a first open position, a closed position and a second open position different from said first open position and beyond said closed position with respect to said housing;

the housing defining a sample flow channel with an opening at a proximal end of said housing, wherein said opening is protected by said cap when said cap is in the closed position and said opening is exposed when said cap is in the first or second open position, said housing further comprising a diagnostic membrane in fluid communication with said sample flow channel.

2. The diagnostic device of claim 1, wherein said arms are flexible.

3. The diagnostic device of claim 1, wherein said arms are tapered.

4. The diagnostic device of claim 1, wherein at least one of said arms comprises a cap lock member for releasably engaging a corresponding housing lock member on said housing to form a lock that maintains said cap in the closed position.

5. The diagnostic device of claim 4, wherein the cap lock member is a protuberance and the housing lock member is a groove.

6. The diagnostic device of claim 4, wherein the cap lock member is a groove and the housing lock member is a protuberance.

7. The diagnostic device of claim 1, further comprising a stop extending from said end of said central body between said arms for contacting a point on said housing and preventing said cap from pivoting beyond said closed position to said second open position.

8. The diagnostic device of claim 1, wherein said central body comprises a sloping surface and side walls that cooperate to form a sample transfer device guide channel, said channel terminating at a point on said end of said central body between said arms.

9. The diagnostic device of claim 8, wherein said guide channel aligns with an indent in the housing when the cap is in the closed position.

10. The diagnostic device of claim 1, wherein the cap hinge member is a post and the housing hinge member is an aperture.

11. The diagnostic device of claim 1, wherein the cap hinge member is an aperture and the housing hinge member is a post.

12. The diagnostic device of claim 1, wherein said housing has a proximal end for engaging said cap, a distal end, and a midpoint thereinbetween, said hinge axis being located between said midpoint and said proximal end.

13. The diagnostic device of claim 12, wherein the proximal end of said housing is tapered.

14. The diagnostic device of claim 13, wherein said housing has a viewing window between said proximal end and said distal end, said hinge axis being located between said viewing window and said proximal end.

15. The diagnostic device of claim 1, wherein said central body comprises a gripping surface and/or writing surface.

16. The diagnostic device of claim 1, wherein said cap is transparent.

17. The diagnostic device of claim 1, wherein said housing is provided with an upper half and a lower half that attach to one another to enclose said membrane.

18. The diagnostic device of claim 1, wherein said membrane is a lateral flow membrane.

19. The diagnostic device of claim 18, wherein said membrane is an enzymatic detection membrane or an immunodetection membrane.

20. The diagnostic device of claim 1, wherein said sample is selected from the group consisting of whole blood, serum, plasma, urine, saliva, sweat, spinal fluid, lacrimal fluid, vaginal fluid, semen, tissue lysate and combinations thereof.

21. The diagnostic device of claim 20, wherein said sample is whole blood.

22. The diagnostic device of claim 1, wherein said sample is provided in a volume of about 50 μl or less or 20 μl or less.

23. The diagnostic device of claim 1, wherein said device is transparent.

24. The diagnostic device of claim 1, wherein said arms and said central body are planar with respect to one another.

25. A diagnostic device comprising:

a diagnostic membrane;

a housing enclosing the diagnostic membrane, the housing defining a sample flow channel with an opening in a proximal end of said housing for applying a biological sample to the membrane and comprising two housing hinge members disposed on opposing sides of the housing; and a cap for engaging the housing, the cap comprising a central body, two flexible arms extending from opposing sides of one end of said central body, said arms being substantially parallel, each of said arms comprising a cap hinge member for engaging one of said housing hinge members on said housing;

wherein said cap hinge members and said housing hinge members define a hinge axis around which said cap is pivotable in order between a first open position, a closed position and a second open position different from said first open position and beyond said closed position with respect to said housing.

26. The device of claim 25, wherein said opening is protected by said cap when said cap is in the closed position and said opening is exposed when said cap is in the open position.

27. The device of claim 25, wherein said housing is provided with an upper half and a lower half that attach to one another to enclose a membrane that is in fluid communication with said sample flow channel.

28. The device of claim 25, wherein said membrane is a lateral flow membrane.

29. The device of claim 28, wherein said membrane is an enzymatic detection membrane or an immunodetection membrane.

30. The device of claim 25, wherein said sample is selected from the group consisting of whole blood, serum, plasma, urine, saliva, sweat, spinal fluid, lacrimal fluid, vaginal fluid, semen, tissue lysate and combinations thereof.

31. The device of claim 30, wherein said sample is whole blood.

32. The device of claim 25, wherein said sample is provided in a volume of about 50 μl or less or about 20 μl or less.

33. The device of claim 25, wherein said device is transparent.

34. The device of claim 25, wherein said arms and said central body are planar with respect to one another.

* * * * *